US006742501B2

(12) United States Patent
Hirano

(10) Patent No.: US 6,742,501 B2
(45) Date of Patent: Jun. 1, 2004

(54) METHOD OF ESTIMATING INERTIA MOMENT OF ENGINE, METHOD OF ESTIMATING ENGINE LOAD, AND METHOD OF AND APPARATUS FOR CONTROLLING ENGINE

(75) Inventor: Katsuhiko Hirano, Yokkaichi (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/173,563

(22) Filed: Jun. 18, 2002

(65) Prior Publication Data

US 2002/0189587 A1 Dec. 19, 2002

(30) Foreign Application Priority Data

Jun. 18, 2001 (JP) ..... 2001-183230

(51) Int. Cl.[7] ..... F02P 5/00

(52) U.S. Cl. ..... 123/406.24; 123/436; 701/111; 701/115

(58) Field of Search ..... 123/406.24, 406.16–406.35, 123/406.54, 406.58, 406.61, 406.64, 436, 339.11, 339.19, 179.22; 701/111, 115

(56) References Cited

U.S. PATENT DOCUMENTS 4,627,275 A * 12/1986 Henein et al. ..... 73/112
4,862,851 A * 9/1989 Washino et al. ..... 123/339.11
5,385,014 A * 1/1995 Rathbun ..... 60/39.02
5,588,409 A * 12/1996 Mizuno et al. ..... 123/339.11
5,964,191 A * 10/1999 Hata ..... 123/41 E
6,065,449 A * 5/2000 Fukuma ..... 123/436
6,199,007 B1 * 3/2001 Zavarehi et al. ..... 701/111
6,513,488 B2 * 2/2003 Enoki et al. ..... 123/305

FOREIGN PATENT DOCUMENTS

JP 4-60151 2/1992

* cited by examiner

*Primary Examiner*—Willis R. Wolfe
*Assistant Examiner*—Johnny H. Hoang
(74) *Attorney, Agent, or Firm*—Nixon & Vanderhye PC

(57) ABSTRACT

An inertia-related engine speed fluctuation is computed when the engine is rotated without ignition. A load-related engine speed fluctuation is computed when the engine is rotated with ignition and combustion. The inertia-related engine speed fluctuation is indicative of an inertia moment that is variable in accordance with equipments connected with the engine. The load-related engine speed fluctuation is indicative of an engine load. When estimating the engine load, the inertia-related engine speed fluctuation is considered for removing an influence of the inertia moment on the engine load. The estimated engine load is used for controlling the engine. It is possible to consider the inertia moment into an engine control.

23 Claims, 5 Drawing Sheets

METHOD OF ESTIMATING INERTIA MOMENT OF ENGINE, METHOD OF ESTIMATING ENGINE LOAD, AND METHOD OF AND APPARATUS FOR CONTROLLING ENGINE

CROSS REFERENCE TO RELATED APPLICATION

This application is based on Japanese Patent Application No. 2001-183230 filed on Jun. 18, 2001 the contents of which are incorporated herein by reference.

BACKGROUND OF THE INVENTION

1. Field of the Invention

The present invention relates to a method of estimating inertia moment or load of an internal combustion engine (engine), and a method of and apparatus for controlling the engine.

2. Description of Related Art

An engine control system controls fuel amount and ignition timing in order to operate the engine in best performance. In such an engine control system, fuel amount and ignition timing are controlled according to load of the engine so as to maximize output, improve fuel economy, reduce emission and the like. Therefore it is important to determine engine load in order to keep the engine in best performance. Engine load can be obtained based on a detected intake air amount, a detected opening degree of a throttle valve, a detected intake pressure and the like. In case of detecting such engine operating conditions, the system needs several sensors.

On the other hand, engine load can be estimated based on rotating engine speed. For instance, engine load can be estimated based on an engine speed fluctuation. The engine speed fluctuation can be obtained by monitoring a cyclic engine speed fluctuation At around a compressing top dead center of the engine as shown in FIG. 9. In FIG. 9, the engine speed fluctuation $\Delta t$ is determined by detecting a maximum engine speed and a minimum engine speed during a combustion cycle of the engine. In FIG. 9, IN indicates an intake stroke, and EX indicates an exhaust stroke. The engine speed fluctuation $\Delta t$ is substantially proportional to the engine load as shown in FIG. 10.

However, the relationships between the engine speed fluctuation and the engine load may vary in accordance with inertia moment which is rotational inertia moment on a crankshaft of the engine. In FIG. 10, lines A, B, and C indicate relationships between the engine speed fluctuation and the load under different inertia moments. Magnitudes of the inertia moments are as follows, $A<B<C$. Therefore, in order to estimate the engine load, it is necessary to obtain a parameter indicative of the inertia moment of the engine.

However, it is difficult to determine the inertia moment of the engine, because engine equipments can be changed. For example, in a multi-purpose engine, a purchaser of the engine will combine the engine with several equipments, and a user may replace the equipment. Therefore, it is difficult to determine the inertia moment of the engine at the time of manufacturing and shipping the engine. It is also difficult to adjust the inertia moment of the engine after combining the equipment on the engine, because such adjusting process will be complex and the user has to spend time.

Such a disadvantage may arise when estimating conditions of the engine that is affected by the inertia moment of the engine besides estimating the engine load as described above.

SUMMARY OF THE INVENTION

It is an object of the present invention, to provide a method that is capable of estimating inertia moment of an engine accurately.

It is another object of the present invention, to provide a method that is capable of estimating engine load accurately based on an estimated inertia moment of the engine directly or indirectly.

It is a still another object of the present invention, to provide a method of and apparatus for controlling an engine based on an estimated engine load.

According to an embodiment of the present invention, an inertia-related engine speed characteristic is obtained/measured when the engine is rotated without ignition. Therefore, the engine speed fluctuation reflects the inertia moment. As a result, the inertia-related engine speed characteristic is indicative of an inertia moment of the engine. The engine speed characteristic may be an engine speed fluctuation at a predetermined period or a predetermined stroke of the engine.

According to an embodiment of the present invention, an inertia-related engine speed fluctuation is obtained when the engine is rotated without ignition. The inertia-related engine speed fluctuation is indicative of an inertia moment of rotation of the engine. Therefore it is possible to control the engine in accordance with the inertia moment. The embodiment is based on knowledge that a fluctuation of the engine speed is increased around a compression top dead center of the engine when the engine is rotated without ignition and the fluctuation has a correlation to an inertia moment of the engine. In the invention, the inertia moment is estimated by using the correlation. Therefore it is possible to achieve the inertia moment without additional devices.

The estimated inertia moment can be used for several purposes that are influenced by the inertia moment. For example, the inertia moment can be used for estimating an engine load. But, the inertia moment can be indicated by another parameter such as the inertia-related engine speed fluctuation.

The engine load can be estimated accurately, because an influence of the inertia moment can be compensated. For example, the inertia moment can be reflected directly or indirectly on the estimating process. In case of above, it is possible to estimate the engine load accurately even if the equipment attached on the engine is not identified.

The estimated engine load can be used for controlling the engine. It is possible to achieve an adequate engine control in accordance with the engine load.

The engine speed fluctuation obtaining means may be a means for computing the engine speed fluctuation. For example, an engine speed fluctuation can be represented by a fluctuation of rotation angle within a predetermined time period, or, contrarily, a fluctuation of time periods for rotating a predetermined angle. The fluctuation of rotation angle can be obtained as a fluctuation of number of detected pulse signals. The fluctuation of time periods can be obtained as a fluctuation of number of clock pulses. The engine speed fluctuation obtaining means obtains the fluctuation within one cycle of the engine rotation. More specifically, at least a fluctuation between before and after a compression top dead center is obtained.

The inertia-related engine speed fluctuation and the load-related engine speed fluctuation are both the engine speed fluctuation detected by the means, and are characterized by periods for measuring the fluctuations.

For example, the inertia-related engine speed fluctuation is measured around the compression top dead center because the engine speed shows relatively large fluctuation. But the measuring period is determined to obtain a sufficient correlation between the fluctuation and the inertia moment. For example, a leading part of a momentary fall of the engine speed at the compression top dead center can be used for measuring the fluctuation. A trailing part of the momentary fall of the engine speed at the compression top dead center can be also used for measuring the fluctuation. In FIGS. 1 and 2, the momentary fall of the engine speed is illustrated, and exemplifies the case of using the trailing part of the momentary fall.

On the other hand, in case of obtaining the load-related engine speed fluctuation, the period for measuring is not limited around the compression top dead center of the engine. For example, the load-related engine speed fluctuation can be obtained based on a maximum and minimum engine speed in one cycle of the engine as shown in FIG. 9. Further, a period between a compression stroke and a combustion stroke or periods on both ends of the combustion stroke may be used for measuring the load-related engine speed fluctuation.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 3:
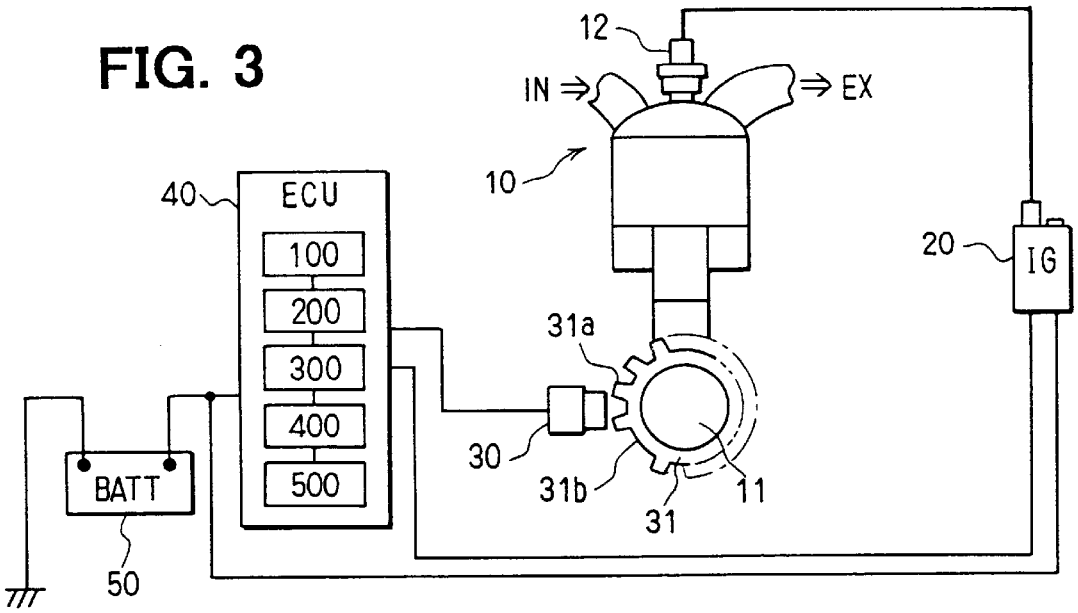
FIG. 3 is a block diagram showing an engine control system according to the embodiment of the present invention.

Referring to FIG. 3, an engine control system 1 is applied to a 4-stroke single-cylinder internal combustion engine (engine) 10. An engine speed sensor is disposed on the engine 10. The engine speed sensor has a rotor 31 with teeth 31*a* and a magnetic sensor 30. The rotor 31 is fixed on a crankshaft (output shaft) 11 of the engine 10. The magnetic sensor 30 detects the teeth 31*a* and outputs pulse signal indicative of the teeth 31*a*. The rotor 31 has a plurality of teeth 31*a*, e.g. twenty-two (22), located every fifteen (15) crank angle degrees (° CA) and two vacant positions 31*b* corresponding to thirty(30) crank angle degrees (° CA). The system 1 has an electronic control unit (ECU) 40 powered by a battery 50. The ECU 40 controls an ignition device including an ignition coil 20. The ignition coil 20 generates high-tension voltage in response to an ignition signal from the ECU 40 and generates a spark on an ignition plug 12 threaded into a cylinder head of the engine 10.

The engine speed sensor provides means for detecting an engine speed. A photo sensor, a photoelectric sensor or an electromagnetic sensor can be used for the engine speed sensor. An engine revolution number, a rotation angle or a crank angle, may represent the engine speed. The engine speed can be detected on a rotating shaft or a member that is coupled with the crankshaft.

When the crankshaft 11 rotates, the magnetic sensor 30 supplies pulse signals to the ECU 40. The ECU 40 detects rotation degree of the crankshaft 11 based on the pulse signals. The ECU 40 computes an engine speed at a plurality of rotating positions of the crankshaft 11. As a result, instantaneous engine speeds are achieved. The ECU 40 compares the detected rotation degree with a reference clock (pulse number) for detecting information indicative of the engine speed. The ECU 40 counts and measures a period of time for a predetermined detected rotation degree of the engine (engine speed fluctuation computing step).

The ECU 40 has several memory devices, CPU, I/O ports and the like, which provide means for obtaining an engine speed fluctuation, means for estimating an inertia moment and means for estimating an engine load. The memory devices memorize several data tables and the like described below.

The ECU 40 executes the following process.

(1) Step 100

Figure 1:
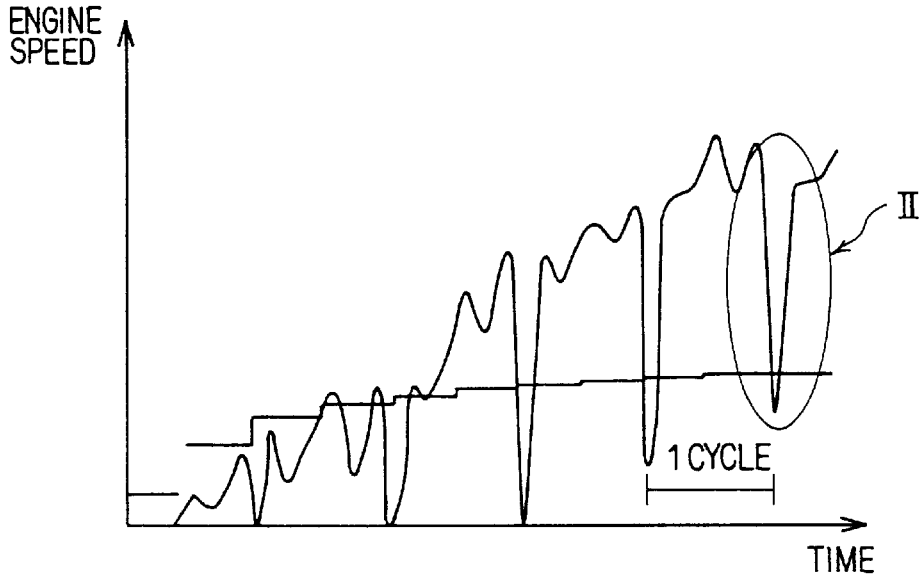
FIG. 1 is a time chart showing an engine speed according to an embodiment of the present invention.
Figure 2:
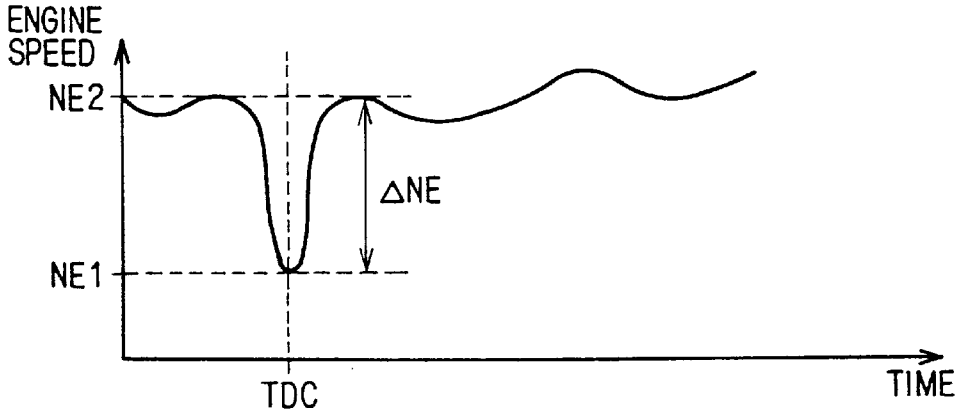
FIG. 2 is an enlarged view showing a part of FIG. 1 indicative of inertia-related engine speed fluctuation according to the embodiment of the present invention.

In a step 100, an inertia-related engine speed fluctuation is computed based on the output signal from the engine speed sensor. FIGS. 1 and 2 show an engine speed during the engine is rotated without ignition. The engine speed roughly changes just after the engine is started. However, as the engine speed increases, the engine speed shows significant cyclic fall around a compression top dead center. FIG. 2 shows one of the falls of the engine speed at a compression top dead center when the engine reaches a stable rotation. When the engine speed increased to a predetermined speed, the ECU 40 determines that the engine 10 reaches to a no ignition rotation. Then, the ECU 40 computes an instantaneous bottom engine speed NE1 and an instantaneous peak engine speed around the compression top dead center. The ECU 40 computes a difference ΔNE from the NE1 and NE2. The difference ΔNE is computed as an inertia-related engine speed fluctuation.

The no ignition rotation is that the engine 11 rotates without ignition such as a cranking condition. An ignition rotation is that the engine 11 rotates itself with ignition and combustion.

Computing process of the inertia-related engine speed fluctuation in the no ignition rotation is executed after the engine is connected with equipment such as machinery. Therefore, if the inertia moment will not be changed after connecting the engine and machinery, the computing process of the inertia-related engine speed fluctuation may be executed only once just after connecting the engine and machinery. The computing process of the inertia-related engine speed fluctuation may be executed every starting of the engine, e.g. at the cranking condition or the like.

In this embodiment, the inertia moment of the engine may be estimated based on an inertia-related engine speed fluctuation that is computed while the engine speed is increasing. The inertia moment is estimated based on the inertia-related engine speed fluctuation that is computed just after a beginning of the cranking of the engine and the engine speed still increases. In the case of above, it is possible to estimate the inertia moment in a short period of time. But, preferably, the inertia-related engine speed fluctuation is computed when the engine is in a no ignition and stable rotation in which the engine 11 rotates without ignition, and rotates stably. Preferably, the ECU 40 computes the inertia-related engine speed fluctuation when an average engine speed is constant and the engine is in the no ignition rotation. In this case, it is possible to compute the inertia-related engine speed fluctuation stably, and estimate the inertia moment accurately.

(2) Step 200

Figure 4:
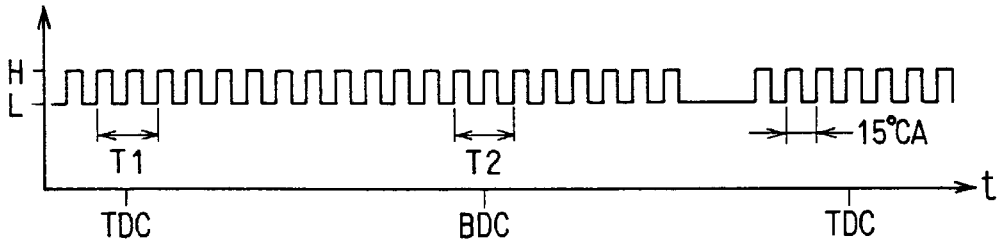
FIG. 4 is a time chart showing a pulse signal of an engine speed sensor indicative of load-related engine speed fluctuation according to the embodiment of the present invention.

In a step 200, a load-related engine speed fluctuation is computed based on the output signal from the engine speed sensor when the engine 10 is in the ignition rotation. Referring to FIG. 4, one of methods of computing the load-related engine speed fluctuation is explained. A difference between periods of times for predetermined crank angles each located before and after a combustion stroke of the engine 10 is computed as the load-related engine speed fluctuation. For example, a difference at between a period of time T1 for thirty (30) crank angle degrees (° CA) at a compression top dead center and a period of time T2 for thirty (30) crank angle degrees (° CA) at a point after 180 (° CA) from the compression top dead center.

Figure 5:
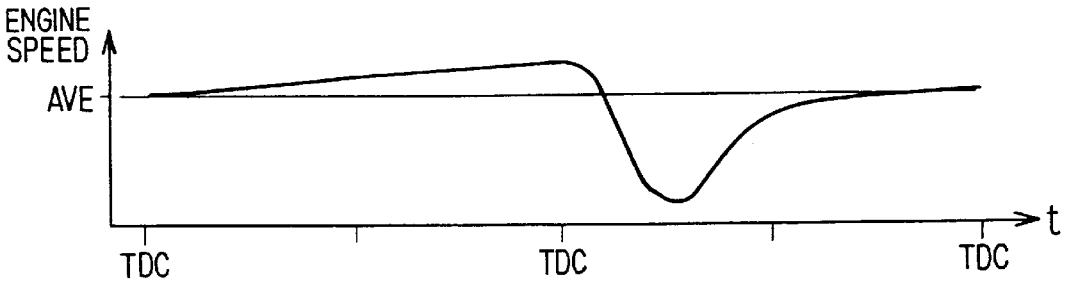
FIG. 5 is a time chart showing an engine speed indicative of load-related engine speed fluctuation according to the embodiment of the present invention.

Referring to FIG. 5, another one of methods of computing the load-related engine speed fluctuation is explained. In this case, differences between instantaneous engine speeds and an engine speed average AVE are computed, and are accumulated for one combustion cycle. The accumulated difference is set as the load-related engine speed fluctuation. For example, the ECU 40 measures every periods Ti of the pulse signals. In the vacant position 31*b*, the measured period is assumed as three (3) times of ordinary periods and is accumulated after being divided by three (3), since the vacant position 31*b* corresponds to 45 crank angle degrees (° CA).

In this embodiment, the former method is employed in the step 200.

(3) Step 300

In a step 300, a parameter that reflects an inertia moment of the engine is computed. In this step, the inertia moment may be estimated directly based on the inertia-related engine speed fluctuation Δt. But, estimating the inertia moment is not necessary in case of finally estimating an engine load, a corrective coefficient for correcting an engine load would be enough for estimating the engine load while considering the inertia moment.

Figure 6:
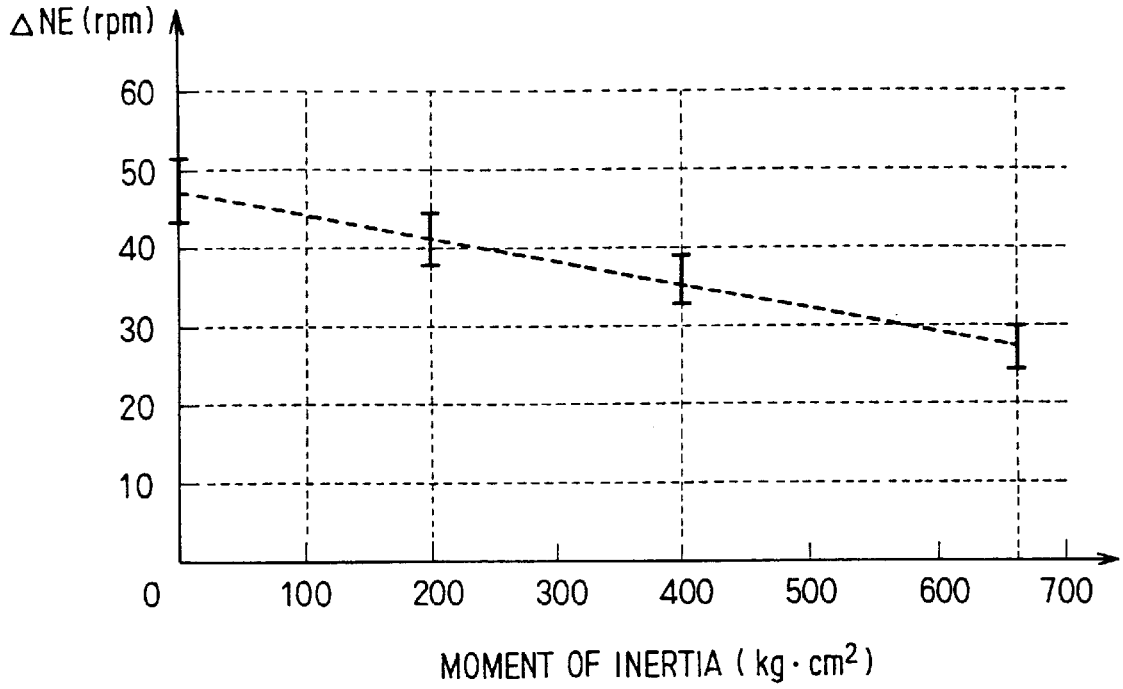
FIG. 6 is a graph showing a relationship between the inertia-related engine speed fluctuation and moment of inertia according to the embodiment of the present invention.

In case of estimating the inertia moment, the inertia moment can be obtained by just looking up a map that defines the inertia moment in accordance with the inertia-related engine speed fluctuation as shown in FIG. 6. In FIG. 6, it is clearly understood that the inertia moment is proportional to the inertia-related engine speed fluctuation ΔNE. Therefore, it is possible to obtain the inertia moment by using a functional expression or a map that are memorized in a memory device in the ECU 40.

Figure 7:
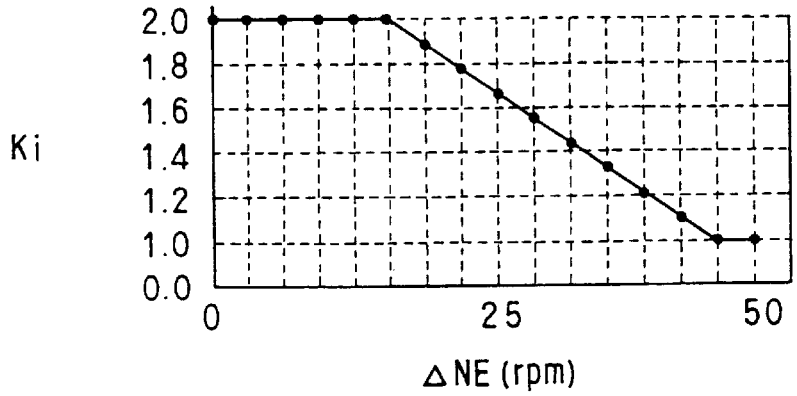
FIG. 7 is a graph showing a relationship between corrective coefficient and inertia-related engine speed fluctuation according to the embodiment of the present invention.

In case of obtaining the corrective coefficient for the engine load or the load-related engine speed fluctuation, the corrective coefficient can be obtained by looking up a map as shown in FIG. 7. The corrective coefficient Ki is obtained in accordance with the inertia-related engine speed fluctuation ONE. According to FIG. 7, the corrective coefficient Ki takes smaller value as the inertia-related engine speed fluctuation ΔNE increases. A small value of the inertia-related engine speed fluctuation ΔNE means a great value of the inertia moment. This means that an influence of the inertia moment is great. Therefore, the corrective coefficient Ki takes relatively great value, 2.0, when the inertia-related engine speed fluctuation ΔNE is sufficiently small. On the other hand, a great value of the inertia-related engine speed fluctuation ΔNE means a small value of the inertia moment. This means that an influence of the inertia moment is small or almost negligible.

Therefore, the corrective coefficient Ki takes relatively small value, 1.0, when the inertia-related engine speed fluctuation ΔNE is sufficiently great. The corrective coefficient Ki is proportionally varied between 1.0 and 2.0.

(4) Step 400

Figure 8:
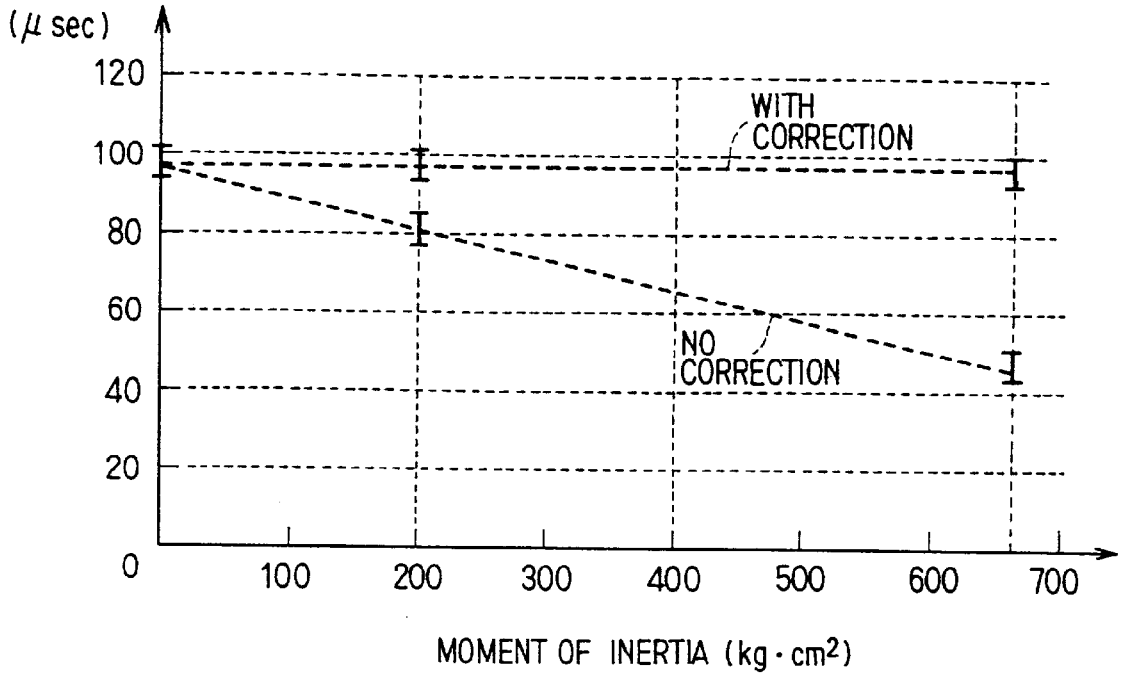
FIG. 8 is a graph showing a relationship between the load-related engine speed fluctuation and moment of inertia according to the embodiment of the present invention.
Figure 9:
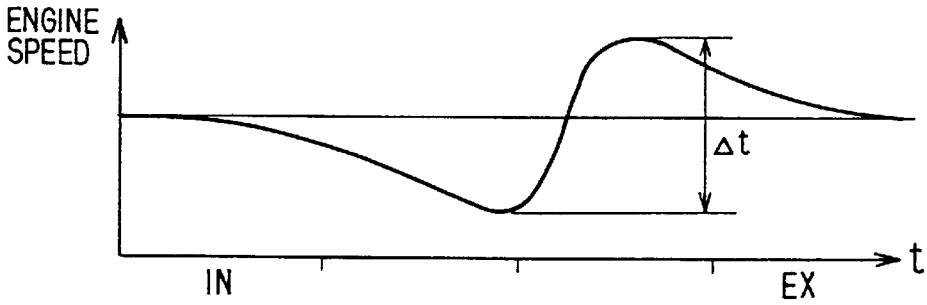
FIG. 9 is a time chart showing an engine speed indicative of engine speed fluctuation.
Figure 10:
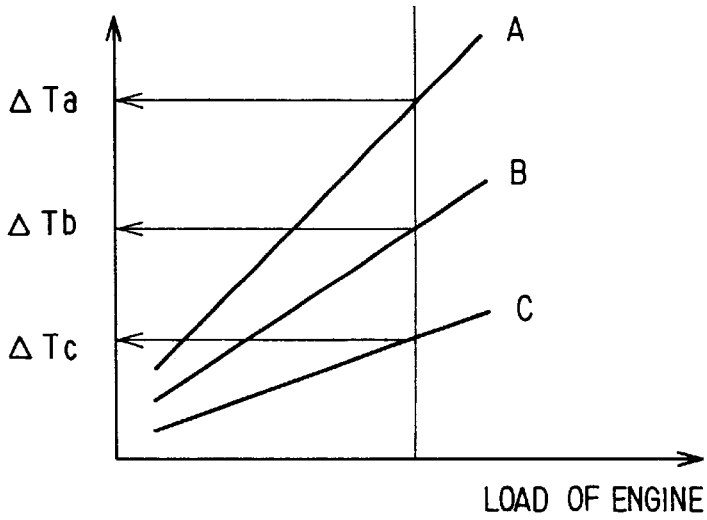
FIG. 10 is a graph showing a relationship between the engine speed fluctuation and load of engine.

In a step 400, an engine load is computed based on the corrective coefficient Ki and the load-related engine speed fluctuation Δt. In the step 400 the load-related engine speed fluctuation is multiplied by the corrective coefficient Ki to obtain a corrected engine speed fluctuation in which the influence of the inertia moment is removed. FIG. 8 shows relationships between the load-related engine speed fluctuation and the inertia moment. In FIG. 8, an inclined line is obtained based on a plurality of measured values of the load-related engine speed fluctuation which are measured under several equipments that obtains different loads on the engine 10. When measuring the load-related engine speed fluctuation, the engine 10 is coupled with several equipments, and is operated with ignition at 3000 rpm, that is the ignition rotation. In FIG. 8, if no correction is applied, the load-related engine speed fluctuation varies in proportion to the inertia moment. But, when the correction by the corrective coefficient Ki is applied, the load-related engine speed fluctuation can be corrected into a constant value with respect to the inertia moment. As a result, the influence of the inertia moment is removed from the load-related engine speed fluctuation, and the corrected load-related engine speed fluctuation can be used for estimating the engine load.

The ECU 40 computes the engine load based on the corrected load-related engine speed fluctuation. In this process, the ECU 40 looks up a map that is memorized in the memory device for estimating the engine load.

The ECU 40 may first compute a primary engine load based on the load-indicative engine speed fluctuation, and then compute an accurate engine load by correcting the primary engine load based on a corrective value determined based on the inertia-related engine speed fluctuation.

In the above-described steps, although several parameters are computed in the ECU 40, those parameters may be replaced by other parameters indicative of the same factors. For example, the engine load can be indicated by another parameter besides the engine load itself. For example, the corrected load-related engine speed fluctuation can be used as a replacement of the engine load, since the corrected load-related engine speed fluctuation is proportional to the engine load. Further, the inertia moment and the corrective coefficient described above are replaceable each other. Therefore, the process of estimating the engine load, and the process of estimating the inertia moment not only means estimating the subject value itself, but also means estimating a replaceable parameter indicative of the subject value.

(5) Step 500

In a step 500, the computed and estimated engine load is applied for controlling ignition timing of the engine 10. It is possible to control the engine adequately based on the engine load. The system 1 may include another variable device for changing operating condition of the engine such as a fuel injection system and a fuel-supply regulating valve. In the case of above, the estimated engine load can be used for controlling the fuel injection system or the fuel-supply regulating valve.

Figure 11:
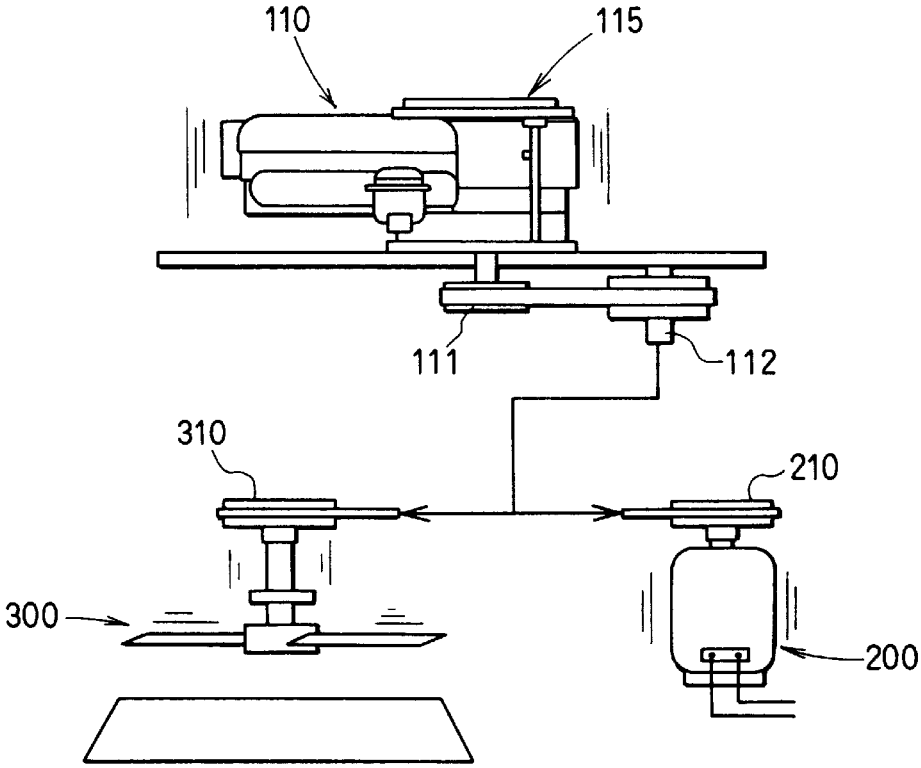
FIG. 11 is a schematic diagram showing an engine and several selectively connectable equipments.

FIG. 11 shows one of applications of this embodiment. An engine 110 is a multi-purpose engine that is the same as the system 1. The engine 110 has a crankshaft 111 rotatably supported on a crankcase 115. The engine 110 has an output shaft 112 that is coupled with the crankshaft 111 via a reduction mechanism. A primary supplier assembles the engine 110 with the ECU 40. The engine 110 is assembled for general use and is shipped. A secondary supplier may be a generator maker, and connects the engine 110 with an input shaft 210 of a generator 200. A secondary supplier may be a lawn mower maker, and assembles a lawn mower by connecting the engine 110 with an input shaft 310 of a rotatable blade 300. A consumer may also use the engine 110 for several purposes, and may change the purpose. Therefore the engine 110 is operated for several uses with different inertia moment.

Although these purposes may obtain different inertia moments, the ECU 40 can estimate the engine load accurately on both purposes since the ECU 40 removes the influence of the inertia moment when controlling the engine. Therefore the ignition timing of the engine 110 can be controlled adequately under different inertia moments. Therefore, the secondary supplier or the consumer is not required to adjust control characteristics of the ECU 40.

The ECU 40 may have a nonvolatile memory device for memorizing the parameter such as at least one of the inertia-related engine speed fluctuation, the load-related engine speed fluctuation, and the estimated inertia moment. The parameters may be memorized temporarily and may be updated in certain intervals.

In the embodiments, although an inertia-related engine speed characteristic for estimating the inertia moment is a fluctuation around the compression top dead center, the inertia-related engine speed characteristic may be an average increasing ratio of the engine speed when the engine is in the no ignition rotation. The average increasing ratio of the engine speed can be used for estimating the inertia moment. However, the inertia-related engine speed fluctuation can obtain more accurate and stable results.

The embodiment can be modified to be applicable to all kind of engines. The embodiment is effective for a multi-purpose engine that is selectively combined with several equipments such as a pump, a generator, a lawn mower, and a grass mower. The embodiment is also effective for a single cylinder engine, because an engine speed fluctuation is easily detected.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An apparatus for controlling an engine, comprising:

means for controlling an ignition device for selectively stopping ignition so that the engine is in a no ignition rotation in which the engine rotates without ignition;

means for obtaining an engine speed fluctuation based on detected engine speed; and means for estimating an inertia moment of the engine based on an inertia-related engine speed fluctuation which is the engine speed fluctuation obtained around a compression top dead center of the engine by the obtaining means when the engine is rotated without ignition.

2. The apparatus for controlling an engine according to claim 1, wherein the engine is a multi-purpose engine usable with several equipments.

3. An apparatus for controlling an engine according to claim 1, wherein said inertia-related engine speed fluctuation is computed based on a output signal from an engine speed sensor.

4. An apparatus for controlling an engine according to claim 1, further comprising means for estimating an engine load based on the inertia moment and means for controlling the engine based on the estimated engine load.

5. An apparatus for controlling an engine, comprising:

means for controlling an ignition device for selectively stopping ignition so that the engine is in a no ignition rotation in which the engine rotates without ignition;

means for obtaining an engine speed fluctuation based on detected engine speed; and means for estimating an engine load based on an inertia-related engine speed fluctuation which is the engine speed fluctuation obtained around a compression top dead center of the engine by the obtaining means when the engine is rotated without ignition and a load-related engine speed fluctuation which is the engine speed fluctuation obtained by the obtaining means when the engine is rotated with ignition.

6. The apparatus for controlling an engine according to claim 5, wherein the engine load estimating means estimates the engine load based on a corrected load-related engine speed fluctuation which is obtained based on the load-related engine speed fluctuation and a corrective coefficient determined based on the inertia-related engine speed fluctuation.

7. The apparatus for controlling an engine according to claim 5, further comprising means for controlling ignition timing or fuel amount based on the engine load estimated by the engine load estimating means.

8. The apparatus for controlling an engine according to claim 5, wherein the inertia-related engine speed fluctuation is the engine speed fluctuation obtained around a compression top dead center of the engine by the obtaining means when the engine is rotated without ignition and stably.

9. The apparatus for controlling an engine according to claim 5, wherein the engine is a multi-purpose engine usable with several equipments.

10. A method of estimating an inertia moment of an engine, comprising:

controlling an ignition device for stopping ignition so that the engine is in a no ignition rotation in which the engine rotates without ignition;

obtaining an engine speed fluctuation based on detected engine speed; and estimating an inertia moment of the engine based on an inertia-related engine speed fluctuation which is the engine speed fluctuation obtained around a compression top dead center of the engine by the obtaining means when the engine is rotated without ignition.

11. The method of estimating according to claim 10, comprising computing the inertia-related engine speed fluctuation when an average engine speed is constant and the engine is in said no ignition rotation.

12. The method of estimating according to claim 10, further comprising estimating an engine load based on the inertia moment and controlling the engine based on the estimated engine load.

13. The method of estimating according to claim 10, wherein said inertia moment is estimated from a map that defines the inertia moment in accordance with the inertia-related engine speed fluctuation.

14. A method of estimating an engine load, comprising:

controlling an ignition device for selectively stopping ignition so that the engine is in a no ignition rotation in which the engine rotates without ignition;

obtaining an engine speed fluctuation based on detected engine speed; and estimating an engine load based on an inertia-related engine speed fluctuation which is the engine speed fluctuation obtained around a compression top dead center of the engine by the obtaining step when the engine is rotated without ignition and a load-related engine speed fluctuation which is the engine speed fluctuation obtained by the obtaining step when the engine is rotated with ignition.

15. The method of estimating according to claim 14, wherein differences between instantaneous engine speed and an engine speed average AVE are computed and accumulated for one combustion cycle and wherein the accumulated difference is set as said load-related engine speed fluctuation.

16. The method of estimating according to claim 14, wherein a difference between periods of time for a predetermined crank angle located respectively before and after a combustion stroke of the engine is computed as the load-related engine speed fluctuation.

17. The method of estimating according to claim 14, further comprising determining a corrective coefficient based on the inertia-related engine speed fluctuation and wherein the engine load is estimated based on a corrective load-related engine speed fluctuation obtained based on the load-related engine speed fluctuation and said corrective coefficient.

18. The method of estimating according to claim 14, further comprising controlling ignition timing or fuel amount based on the estimated engine load.

19. The method of estimating according to claim 18, wherein the estimated engine load is used for controlling the fuel injection system or the fuel supply regulating valve.

20. A method of controlling an engine, comprising:

controlling an ignition device for selectively stopping ignition so that the engine is in a no ignition rotation in which the engine rotates without ignition;

obtaining an engine speed fluctuation based on detected engine speed;

estimating an engine load based on an inertia-related engine speed fluctuation which is the engine speed fluctuation obtained around a compression top dead center of the engine by the obtaining step when the engine is rotated without ignition and a load-related engine speed fluctuation which is the engine speed fluctuation obtained by the obtaining step when the engine is rotated with ignition; and controlling ignition timing or fuel amount based on the engine toad estimated in the estimating step.

21. The method of controlling according to claim 20, wherein a primary engine load is a computed based on the load-related engine speed fluctuation and then an accurate engine load is computed by correcting the primary engine load based on a corrective value determined based on the inertia-related engine speed fluctuation.

22. An apparatus for controlling an engine, comprising:

means for controlling an ignition device for selectively stopping ignition so that the engine is in a no ignition rotation in which the engine rotates without ignition;

means for obtaining an inertia-related engine speed characteristic which appears on the engine speed when the engine is rotated without ignition;

means for controlling the engine based on an inertia moment indicated by the inertia-related engine speed characteristic.

23. The apparatus for controlling an engine according to claim 22, further comprising means for obtaining a parameter indicative of an engine load, and wherein the controlling means is responsive to the parameter, and wherein the controlling means removes an influence of the inertia moment on the engine load based on the inertia-related engine speed characteristic.

* * * * *